United States Patent [19]

Schott et al.

[11] Patent Number: 4,463,524

[45] Date of Patent: Aug. 7, 1984

[54] INDEXABLE INSERT GRINDING MACHINE

[76] Inventors: Lawrence A. Schott, 15940 Warwick Rd., Detroit, Mich. 48223; Roger A. Schott, 13559 Rutland, Detroit, Mich. 48227

[21] Appl. No.: 972,704

[22] Filed: Dec. 26, 1978

[51] Int. Cl.[3] ..... B24B 17/02

[52] U.S. Cl. ..... 51/127; 51/55; 51/124 R; 51/288; 409/94; 409/104

[58] Field of Search ..... 51/101 R, 101 LG, 109 R, 51/119, 125.5, 124 R, 127, 215 AR, 288, 55; 64/27 NM; 409/93, 94, 104, 111

[56] References Cited

U.S. PATENT DOCUMENTS

| | | | |
|---|---|---|---|
| 2,332,603 | 10/1943 | Ross | 51/127 |
| 2,611,220 | 9/1952 | Selby | 51/55 |
| 2,693,063 | 11/1954 | Dillon | 51/127 |
| 3,461,619 | 8/1969 | Hurlbut et al. | 51/127 |
| 3,568,370 | 3/1971 | Wicksall | 51/127 |
| 3,587,192 | 6/1971 | Schnellman | 51/127 X |
| 3,779,038 | 12/1973 | Stuemky | 64/27 NM X |
| 3,905,207 | 9/1975 | Garrison | 64/27 MN X |

*Primary Examiner*—Robert P. Olszewski

*Attorney, Agent, or Firm*—Barnes, Kisselle, Raisch, Choate, Whittemore & Hulbert

[57] ABSTRACT

A machine and procedures for finish grinding of indexable cutting tool inserts made of tungsten carbide and other similar materials which includes a fixture for positioning inserts individually in a work holder and moving the work holder to a position in which the work is adjacent a rotating grinding wheel. Control device moves the insert into contact with the wheel with a gauge limiting the contact and also providing for rapidly turning an insert from one flat edge to another flat edge to avoid overgrinding of the corners and to speed up the ultimate grinding of all of the flat sides of a polygonal insert.

5 Claims, 17 Drawing Figures

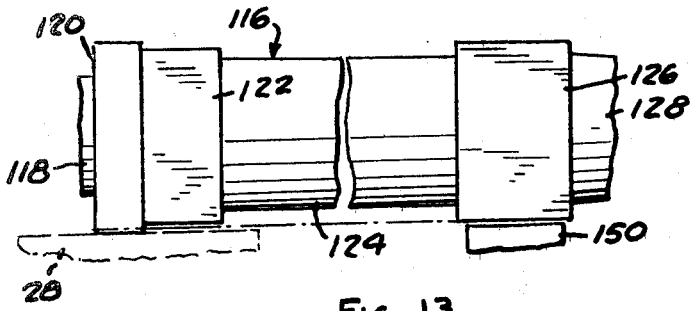
FIG. 13
FIG. 10
FIG. 14
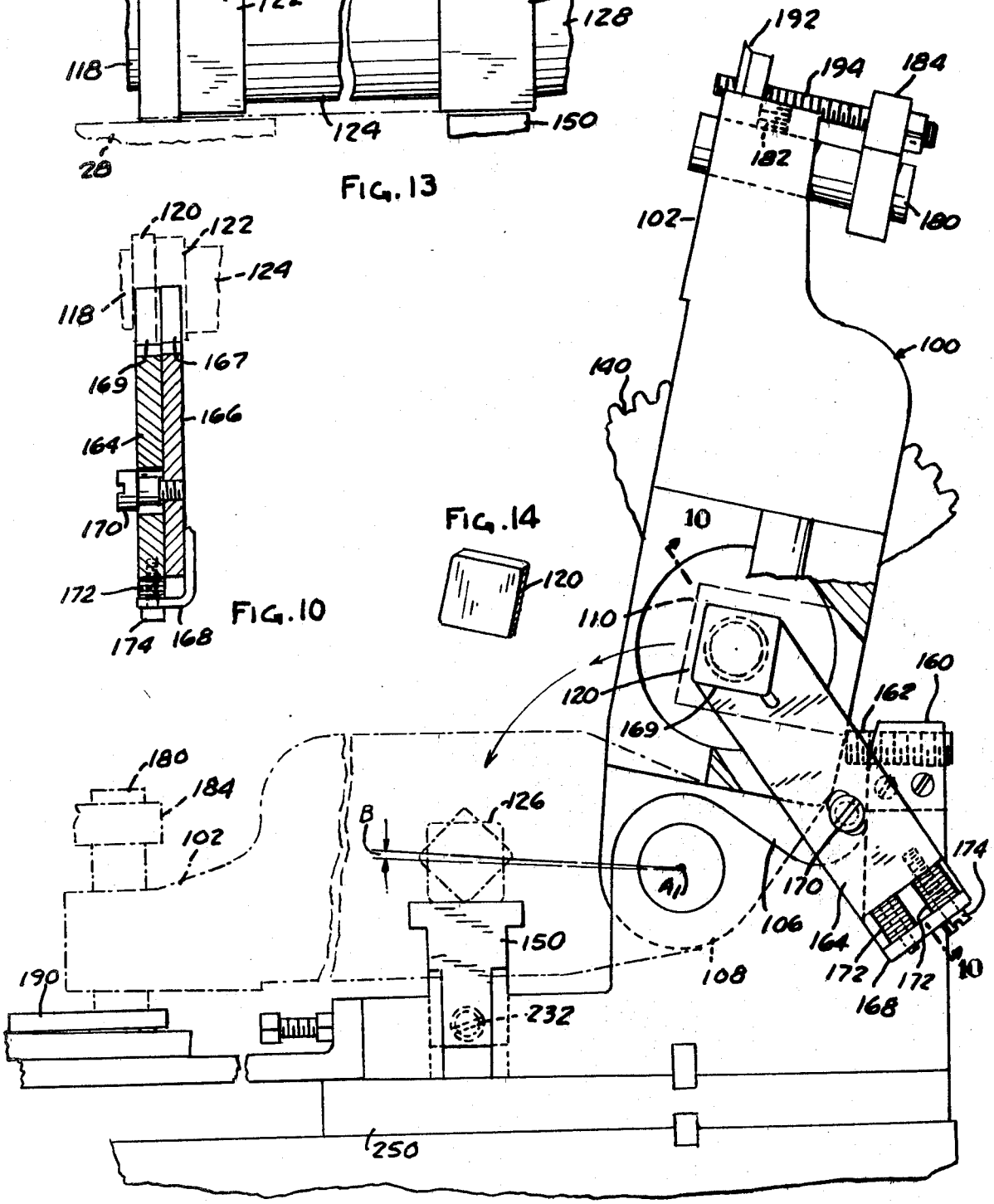
FIG. 9
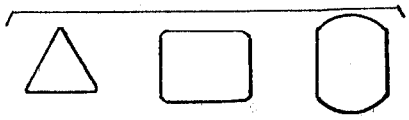
FIG. 15

INDEXABLE INSERT GRINDING MACHINE

FIELD OF INVENTION

Finish grinding of indexable inserts formed of hard metal such as tungsten carbide and used as cutting pieces in toolholders, boring bars, milling cutters and the like.

BACKGROUND OF THE INVENTION

Indexable inserts for toolholders are presently made by pressing powdered metal into various shapes and then sintering in a furnace to establish the hard quality of the material. While much progress has been made in achieving accuracy in the final product, it is still necessary for many installations to have very accurate dimensions in the final product. Many toolholders have multiple pockets and it is desirable to have the inserts accurate in dimension within an acceptable tolerance.

Grinding of the inserts can be done by hand, but it is obviously desirable to achieve the production with machines which can be more accurately controlled for uniformity of the product. Speed of production also reduces the ultimate cost.

It is, therefore, an object of the invention to provide a machine which can grind carbide inserts accurately and rapidly. It is a further object to provide a procedure for grinding inserts which insures uniformity.

Other objects of the invention will be apparent in the following description and claims in which the principles of the invention are set forth together with details of procedures and apparatus which will enable a person skilled in the art to practice the invention, all in connection with the best mode presently contemplated.

BRIEF DESCRIPTION OF THE DRAWINGS

FIG. 9, an enlarged view of a work holder shown in loading and operating position.

FIG. 10, a sectional view on line 10—10 of FIG. 9.

FIG. 13, an enlarged view of an indexing control.

FIG. 14, a perspective view of an insert which can be a workpiece.

FIG. 15, a view of alternative shapes that can be produced on the disclosed machine.

THE GRINDING WHEEL

Figure 1:
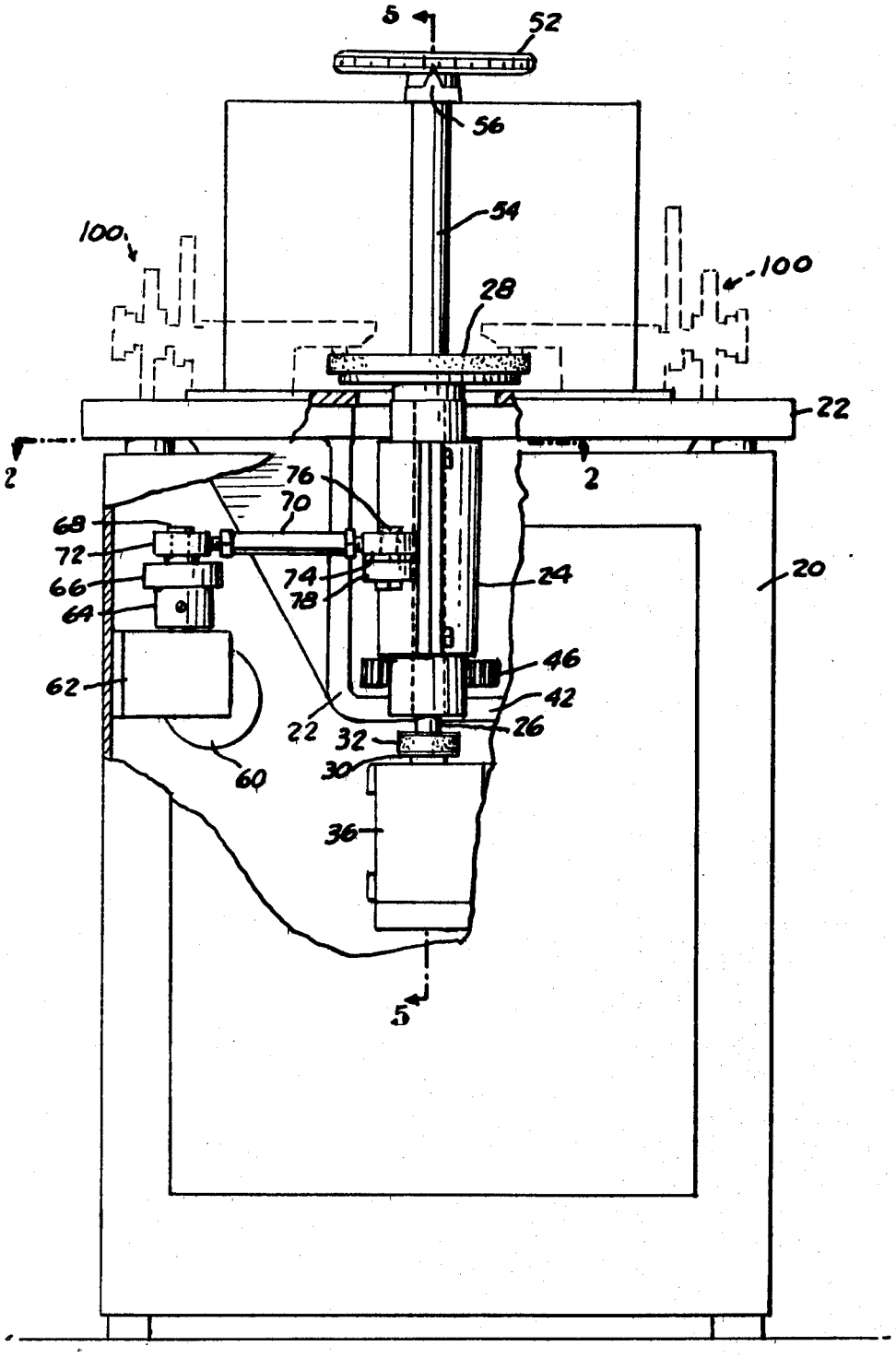
FIG. 1, a front view, partially in section, of the machine for grinding inserts.
Figure 5:
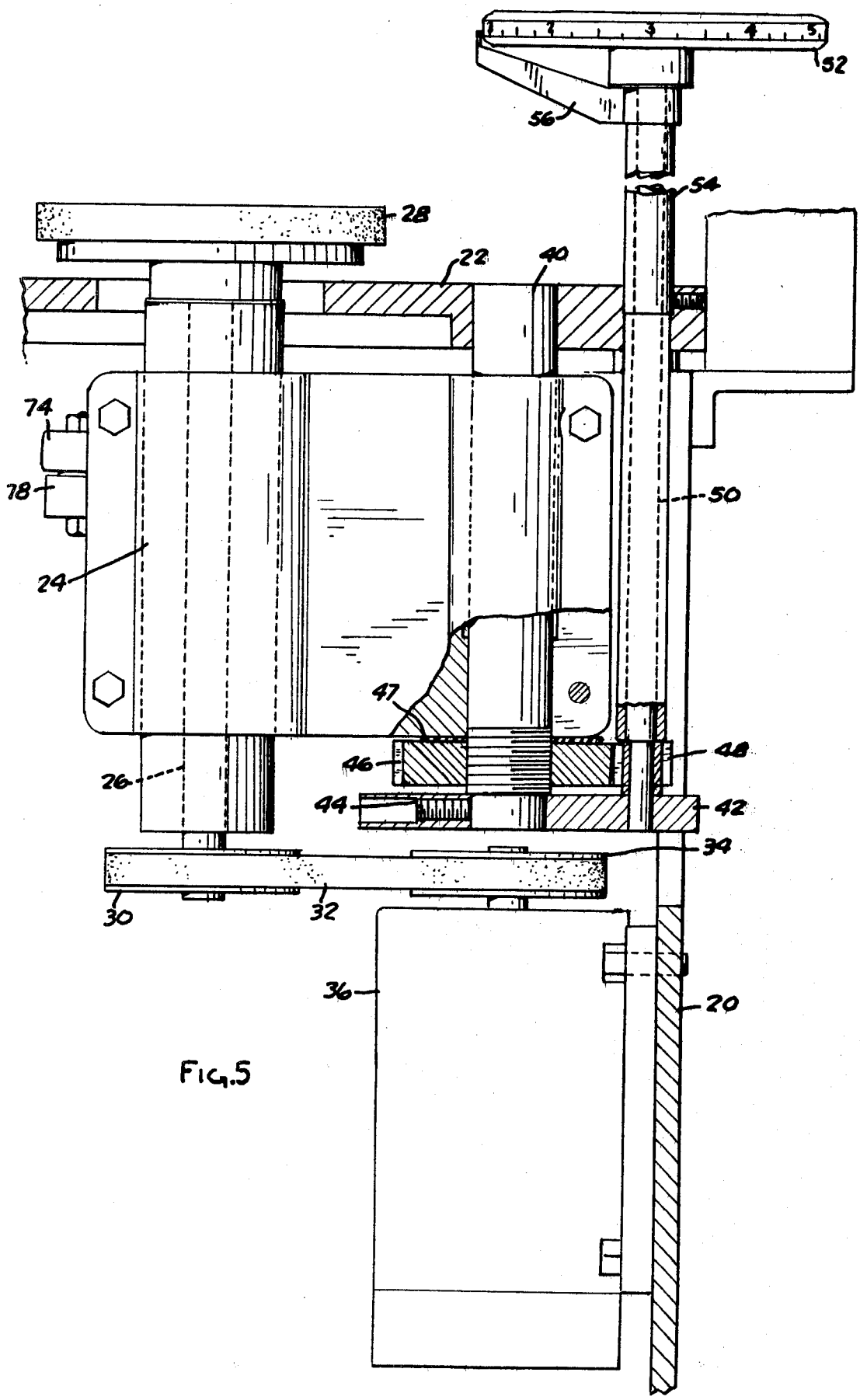
FIG. 5, a vertical section taken on line 5—5 of FIG. 1.

The drawings illustrate the insert grinding machine. In FIG. 1, a front view of the machine shows a frame 20 with a top plate 22. On the frame is mounted a massive journal 24 in which is mounted a shaft 26 carrying at the top end a horizontal grinding wheel 28. See also FIGS. 2 and 5. A pulley 30 is mounted on the bottom end of shaft 26. This pulley is driven by a belt 32 and a pulley 34 driven by motor 36 mounted on the frame.

The journal assembly 24 is mounted for pivotal movement on a heavy vertical shaft 40 which is secured and fixed in the top plate 22 and also in a horizontal plate 42. Set screw 44 locks the shaft in a fixed position. A gear 46 is threaded on the shaft 40 and supports the journal assembly 24. A lubricated bearing pad 47 (FIG. 5) is interposed between gear 46 and the bottom of the journal block 24. This gear 46 meshes with a drive gear 48 on a hand wheel adjusting shaft 50 controlled by a graduated hand wheel 52. A mounting sleeve 54 for shaft 50 mounts also an indicator finger 56. It will be noted that the axis of motor 36 and pulley 34 is coincident with the axis of mounting shaft 40.

Thus, a rotation of adjusting wheel 52 will cause a rotation of the threaded gear 46 and lift or lower the bushing assembly 24 to obtain accurate location of the grinding wheel relative to a work support to be described. This will accordingly permit adjustment of the location of the bushing assembly and the working face of the grinding wheel.

Figure 2:
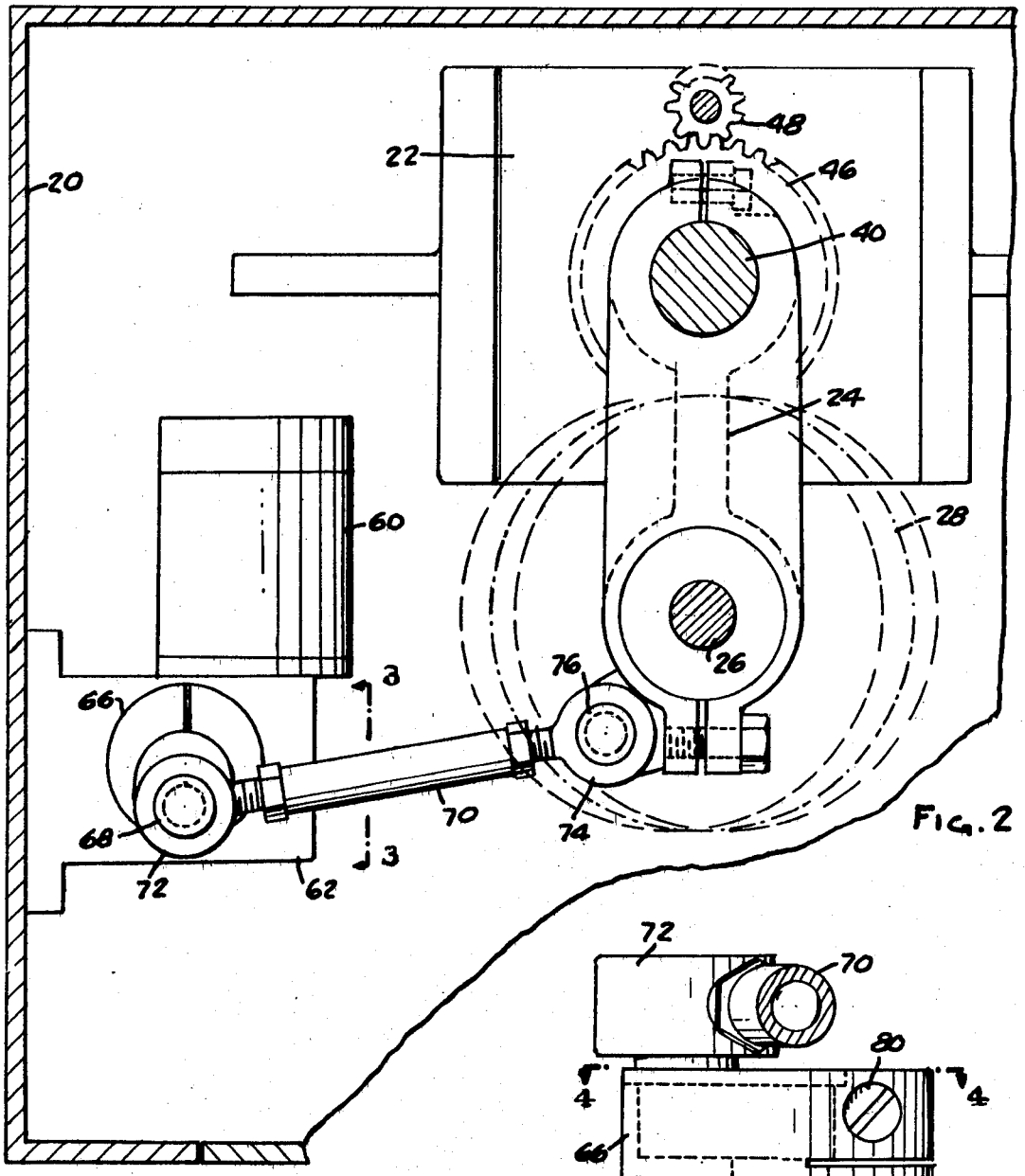
FIG. 2, a sectional view on line 2—2 of FIG. 1.

With reference to FIGS. 1 and 2, the bushing assembly which mounts the grinding wheel 28 may also be shifted by a motor driven assembly. A motor 60 drives a reduction gear 62, the output 64 of which drives an adjustable eccentric 66 with an upstanding pin 68. A link arm 70 with bushings 72 and 74 connects the pin 68 to a side pin 76 mounted on a bracket 78 on bushing assembly 24. Thus, actuation of motor 60 will cause an oscillation of the grinding wheel mount about the axis of shaft 40.

Figure 3:
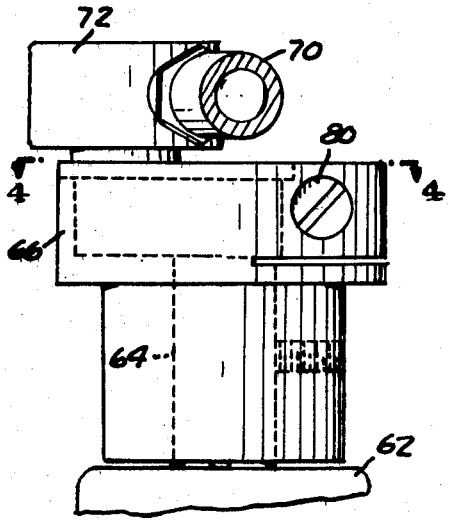
FIG. 3, a sectional view on line 3—3 of FIG. 2.
Figure 4:
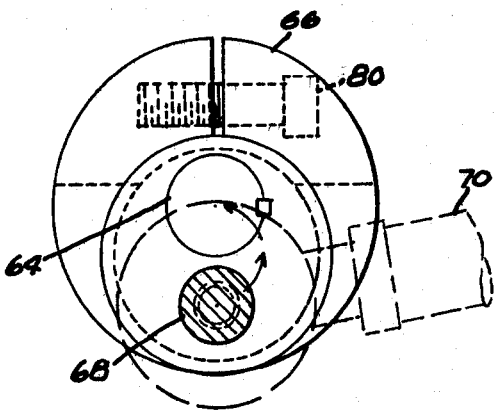
FIG. 4, a sectional view on line 4—4 of FIG. 3.

As shown in FIGS. 3 and 4, the eccentric 66 can be rotated relative to output shaft 64 by loosening the screw 80 to change the eccentric thrust and regulate the motion of link 70.

Thus, the massive bushing assembly 24 serves to permit vertical adjustment of the grinding wheel 28 and also provides the oscillating motion of the wheel as described. The wheel shaft 26 is on a first axis and the mounting shaft 40 is on a spaced parallel second axis.

THE WORK HOLDER

Figure 6:
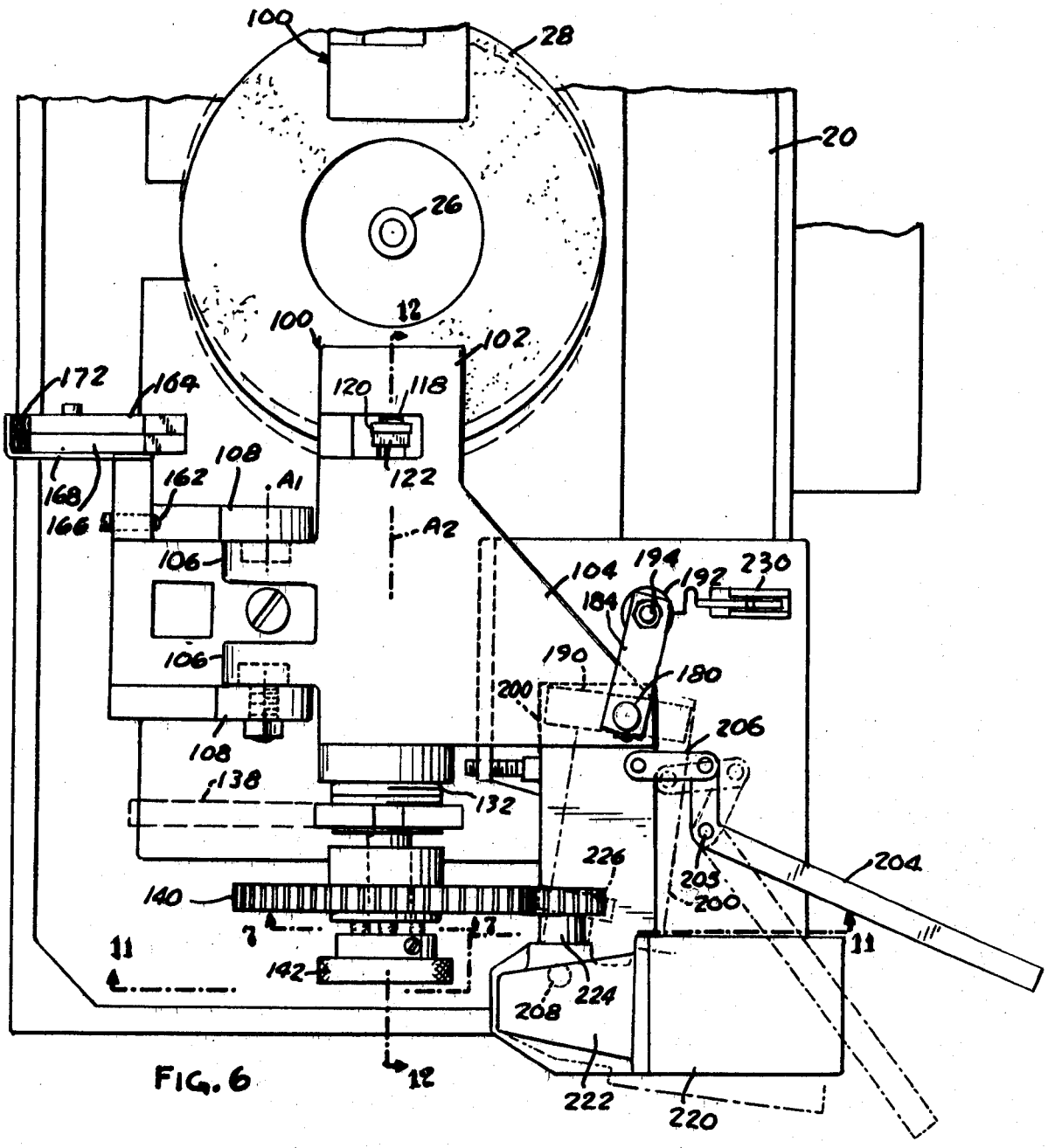
FIG. 6, a plan view of the machine shown in FIG. 1.
Figure 12:
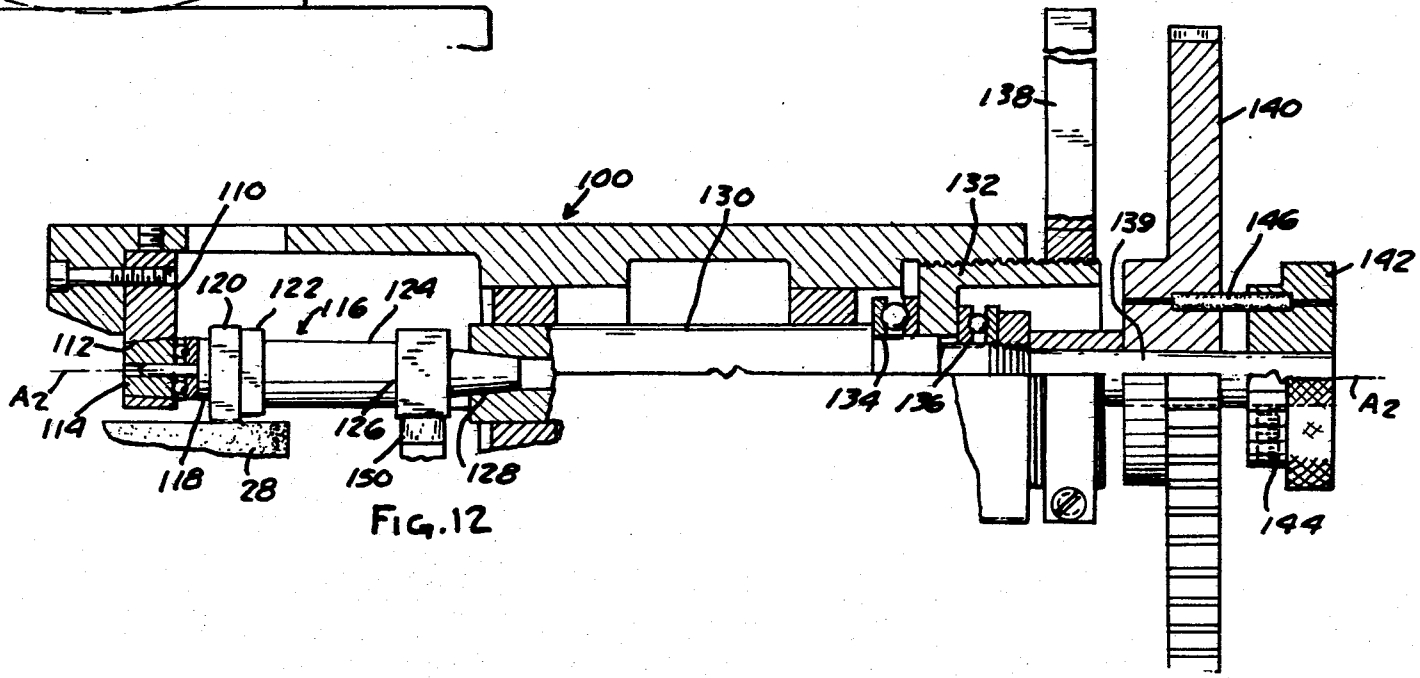
FIG. 12, a section at right angles to that that shown in FIG. 11 taken on line 12—12 of FIG. 6.

In FIG. 1, the work holders are shown in dotted lines at 100. In FIG. 6, a plan view of the work holder 100 is shown. This holder comprises a relatively heavy block of material having a portion 102 overlying the horizontal wheel 28 and a wing portion 104 extending to the right as viewed in FIG. 6. Two spaced lugs 106 at the left serve to mount the holder 100 on brackets 108 so that it will pivot upwardly around axis $A_1$. A sectional view in FIG. 12 shows working parts of the work holder 100 on axis line $A_2$. Above the wheel 28 is a detachable depending bracket 110 with a tapered hole 112 to receive one support end 114 of a work holder assembly 116. The end 114 has a tapered plug to seat in hole 112 and a bearing supported disc 118 to bear against the workpiece 120. On the other side of the workpiece is a disc 122 serving as a pressure plate.

The pressure plate 122 bears against the work 120 backed by a cylinder 124 carrying a gauge block 126 concentric with a tapered end 128 which inserts into a cylinder 130. The gauge block 126 has a configuration similar to the workpiece to be ground and will turn, as later to be described, to lift the workpiece holder and permit the workpiece also to turn from one flat to another. The cylinder 130 can be advanced by a threaded cup 132 which is related to the cylinder 130 by ball bearing races 134 and 136. A lever 138 permits control of the adjusting cup 132.

Figure 7:
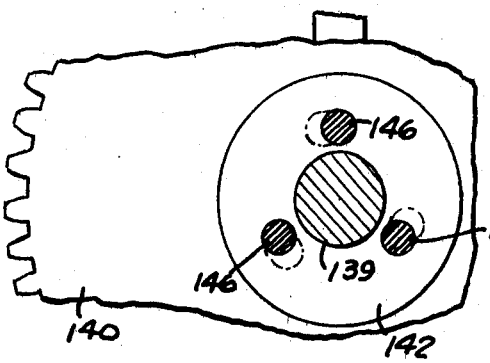
FIG. 7, a sectional view on line 7—7 of FIG. 6.
Figure 8:
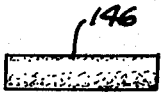
FIG. 8, a view of a torsion dowel.

Cylinder 130 has an extension shaft 139 on which is mounted a gear 140 having free rotation on the shaft. Outside the gear 140 on shaft 139 is a smaller wheel 142 keyed to the shaft by a set screw 144 and having a plurality of axial holes spaced circumferentially and containing rubber dowels 146 which also extend into aligned holes in gear 140. A sectional view is shown in FIG. 7. A rubber dowel is shown in FIG. 8.

A limit block 150, shown in FIGS. 12 and 13, cooperates with gauge 126 to limit the grinding of the work. Various workpieces with polygonal and modified polygonal shapes may be ground on the machine. Some examples are shown on FIGS. 14 and 15.

A workpiece positioning device is utilized to position a workpiece properly in the clamping assembly 116. As viewed in FIG. 9, the work holder is shown in dotted lines in a grinding position and in full lines in a loading-unloading position. An upstanding bracket 160 has an adjustable screw 162 to serve as a stop for the workpiece holder 100 in the open position. Also mounted on bracket 160 is an adjustable finger comprised of two relatively slidable plates 164 and 166. The plates are held rigidly on bracket 160 and held together by an L-shaped member 168 and a headed screw 170. Compression springs 172 are interposed between the underlying leg of member 168 and the plate 164 and an adjustment screw 174 controls the relative position of the plates. Plate 166 has an end recess 167 to fit the disc 122 while the plate 164 has an end recess 169 to receive two sides of a workpiece to position it for clamping between parts 118 and 122. See also FIG. 6.

Thus, when the work holder 100 is in its open position against the stop screw 162, the finger plates 164–166 can receive an insert and hold it while the lever 138 (FIG. 12) is actuated to tighten the insert into the fixture 116.

When the work holder is returned to its operating position with the workpiece properly clamped in place, its initial location relative to the horizontal grinding wheel 28 is established by a post 180 slidably in the wing end 104 and held in an adjusted position by a locking screw 182. The bottom end of this post comes to rest on a cam 190 which establishes the vertical position of the workpiece relative to the grinding wheel prior to the grinding operation. On a cross bracket 184 fastened to post 180 is a switch actuator 192 held by a screw 194.

Figure 11:
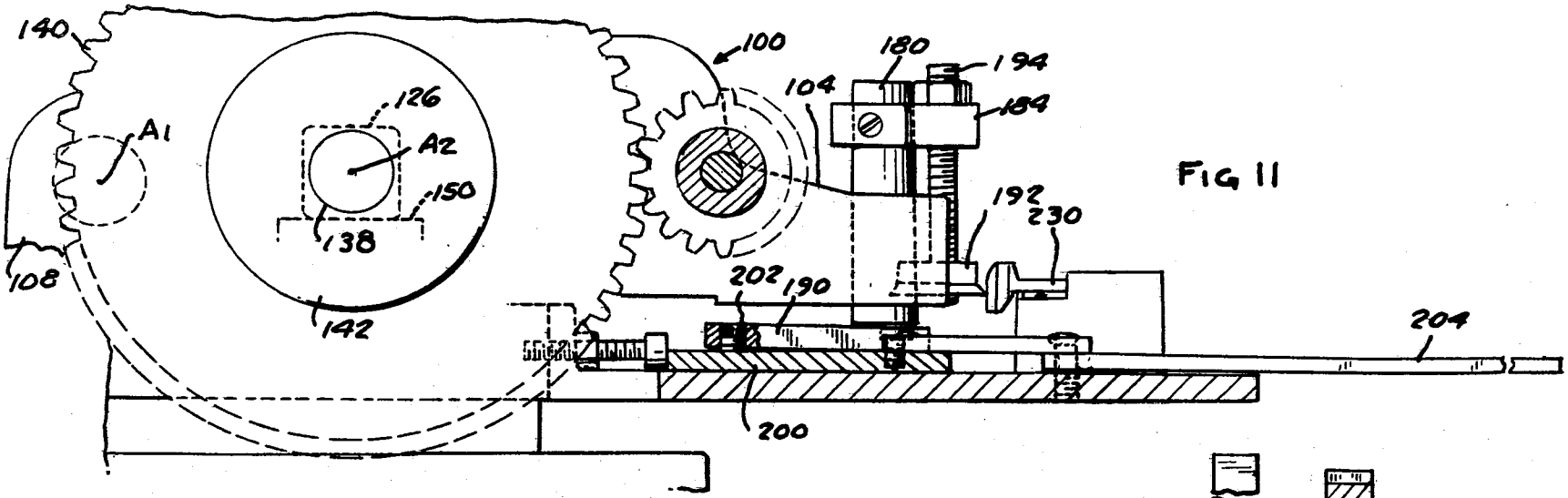
FIG. 11, a sectional view on line 11—11 of FIG. 6.

The cam 190 is mounted (FIG. 6) in a pivoted plate 200. The cam is adjustable vertically at one end by a set screw 202 (FIG. 11). A lever 204 pivoted at 205, through suitable linkage 206, moves the plate 200 around a pivot point 208. Moving lever 204 counterclockwise will shift the plate 200 counterclockwise and lower the post 180 to bring an insert into contact with the grinding wheel.

Also mounted on plate 200 is a motor 220 with a built-in gear reducer 222 and an output shaft 224 carrying a small pinion gear 226 located to mesh with gear 140 when shifted into position. Lever 204 also shifts this gear 226 into engagement with gear 140 when shifted in a counterclockwise direction.

As the cam 190 moves to lower the work holder, the switch actuator 192 actuates a spring-like lever on a slow-fast switch 230 starting the motor 220 in its slow speed phase. This applies torque through the gear 140 to the rubber dowels 146 and the wheel 142 and shaft 130 and tends to turn the workpiece 120. See FIG. 12.

The resilience of the rubber dowels and the resistance to turning of the workpiece allows sufficient time to finish the grinding operation on one flat edge of a workpiece. With the cam 190 out of the way, the work holder will come to rest on the adjustable limit gauge 150 (FIGS. 12 and 13). In FIG. 9, the limit gauge is shown positioned by a set screw 232.

When a prescribed torque is transmitted through the rubber dowels to the shaft 130 holding the workpiece, the gauge block 126 and the workpiece will begin to turn. The corners of the gauge block 126 serve as a cam acting on limit gauge post 150 to raise the work holder slightly about the axis $A_1$ (FIG. 9). See angle B. This slight raising of the work holder will actuate the slow fast switch to a raised position in the fast setting. The rubber dowels will move toward their normal unstressed position with the release of resistance adding speed to the turning operation. Thus, the corners are adequately ground by the faster turning and the work holder is lowered to a flat-grinding position as the gauge block completes its 90° turn. The switch 230 is again moved to the lower slow feed position while the second grinding of a flat edge takes place.

Figure 16:
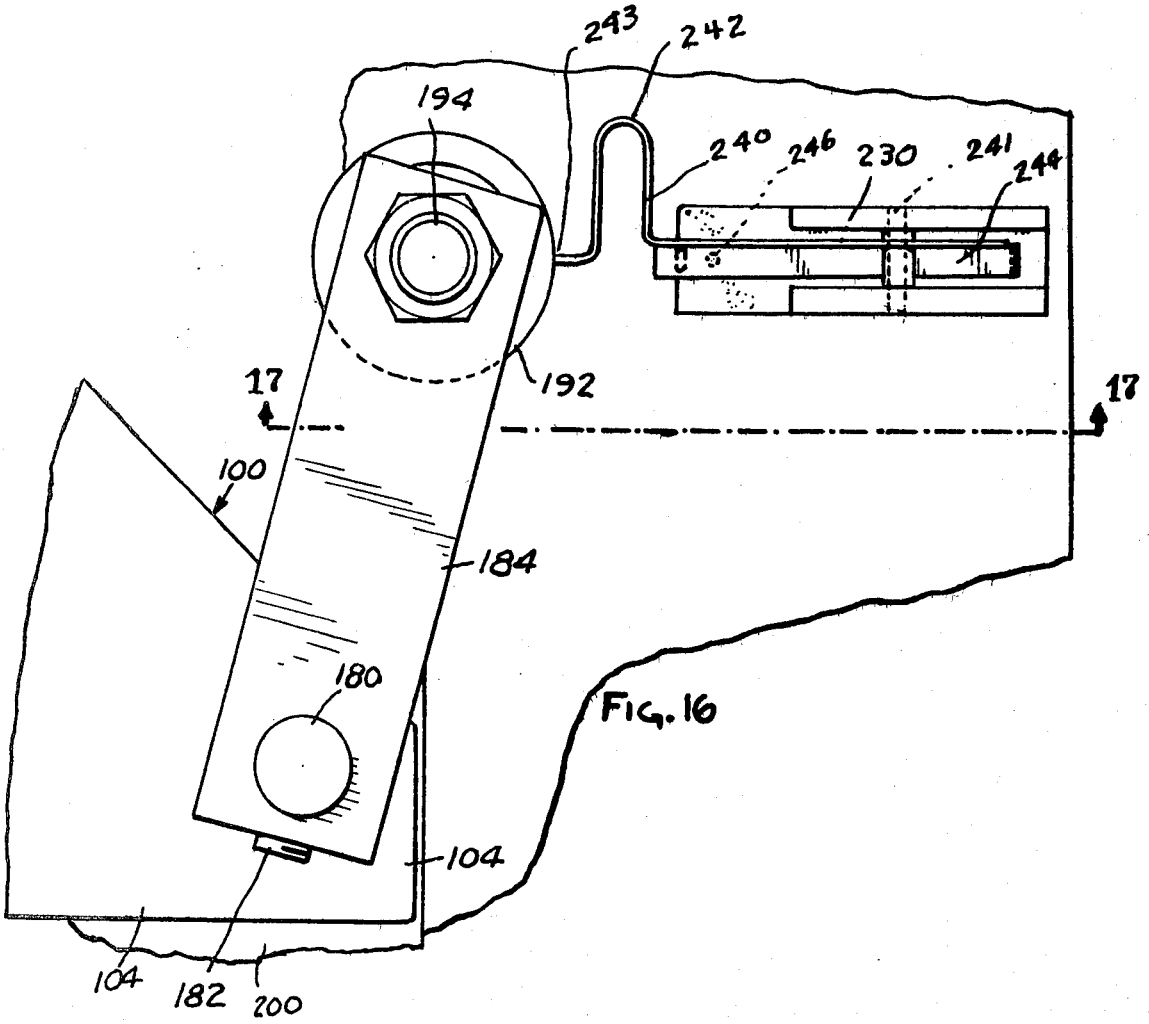
FIG. 16, a top view of the details of a fast-slow switch actuator.
Figure 17:
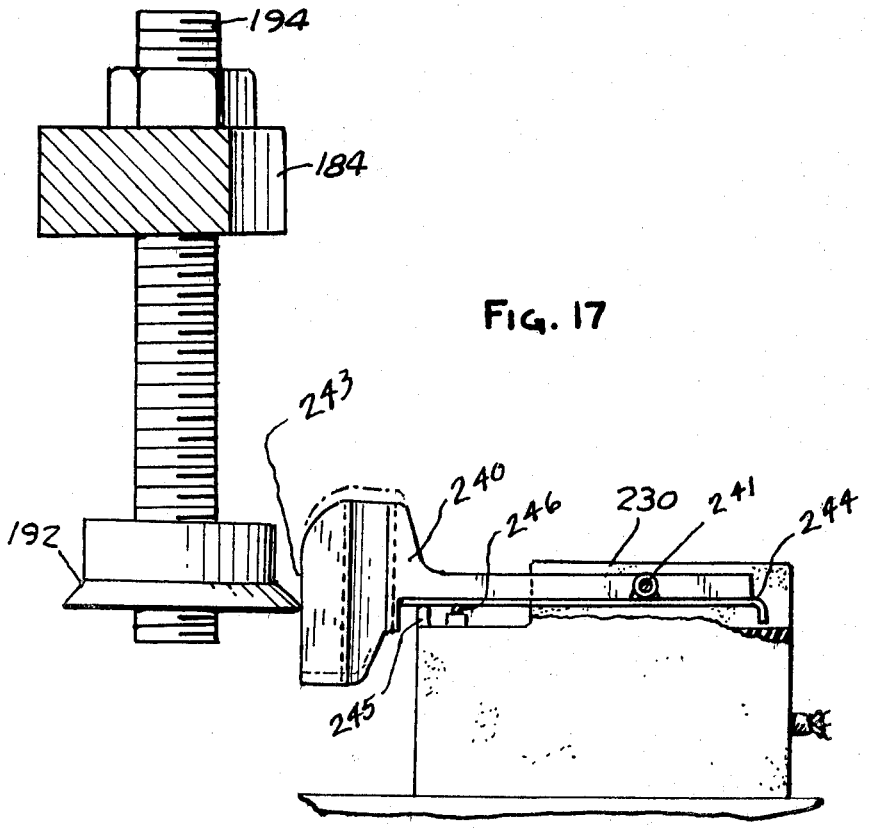
FIG. 17, a side view on line 17—17 of the switch actuator of FIG. 16.

It is to be noted that the switch construction for the slow-fast switch 230 is important to proper operation of the machine. As shown in FIGS. 6 and 11 and in greater detail in FIGS. 16 and 17, the slow-fast switch 230 has a disc-like actuator 192 which is adjustably positioned on screw 194. The edge of disc 192 rides on the edge of a leaf spring switch arm member 240 which pivots on a cross-pin 241 in switch housing 230. The spring has a U-loop 242 which is tensioned to hold the edge 243 of the spring against the edge of the disc 192. The switch arm has a back extension 244 to serve as a stop in the upward motion of the arm 240 and a bottom stop 245. A switch actuator pin 246 actuates the slow-fast switch. Thus, when the wing-end 104 of the work holder block 100 is moved down to permit the contact rod 180 to ride on the cam 190, the actuator disc 192 rubs on the end 243 of the actuator 240 and moves it down to the stop 245, actuating the slow phase of the motor 220. When the block 100 is raised by the camming action of the gauge block 126, the frictional engagement of disc 192 on actuator 240 will immediately affect the position of the actuator to initiate the rapid phase of the motor. Accordingly, there is no lost motion in the switch action to fast position.

When all sides of an insert are ground, the work holder 100 is lifted to an unload-load position and a new insert is installed in place of the ground insert.

The grinding wheel 28 has, of course, been rotating and oscillating by a suitable power control for the driving motors 36 and 60. This motion provides a smoother finish on the inserts and distributes the wear on the grinding wheel.

The machine has been described in connection with the grinding of so-called "negative" inserts in which the side edges are perpendicular to the flat faces of the insert. Positive inserts which have side edges angled to the faces can be ground on the disclosed machine by replacing a spacer 250, shown in FIG. 9, which is doweled to the frame and the work-support assembly, with an angled spacer plate to achieve the necessary side edge angles.

It will thus be seen that the machine permits easy installation of a workpiece into a proper position for grinding gauge means for limiting the grinding on any particular surface and indexing means for moving the insert from flat edge to flat edge in a rapid motion to permit a semi-automatic operation for each insert. The rotation and oscillation of the grinding wheel also insures a proper grinding motion for the insert which is held in the described workpiece holder.

We claim:

1. A machine for grinding the flat edges of polygonally shaped cutting inserts which comprises:
   (a) a grinding wheel having a flat grinding surface,
   (b) a means for rotating said wheel,
   (c) an insert holder for an insert to be ground comprising a movable body positioned adjacent said wheel,
   (d) first means on said holder to mount an insert for rotation,
   (e) second means to drive said first means to cause rotation of an insert during a grinding operation,
   (f) means for mounting said grinding wheel comprising a rotating shaft on a first axis, a massive bushing having a bearing recess to receive said shaft, means pivotally mounting said bushing on a second axis parallel to said first axis wherein said bushing and said shaft may oscillate about said second axis, and an eccentric drive to oscillate said bushing, said shaft and said grinding wheel, and
   (g) said means pivotally mounting said bushing comprising a mounting shaft on said second axis having a threaded portion, a rotatable means threaded on said shaft supporting said bushing, and means to rotate said rotatable means to lift or lower said bushing and said wheel to adjust the vertical position of said wheel.

2. A machine as defined in claim 1 in which said rotatable means comprises a first gear threaded on said mounting shaft, a rotatable indexing wheel and a shaft driven by said wheel having a second gear to drive said first gear.

3. In a machine for grinding the flat edges of polygonal shaped cutting inserts which includes: a grinding wheel having a flat grinding surface, a means for rotating said wheel, and an insert holder for an insert to be ground comprising a movable body positioned adjacent said wheel, that improvement which comprises:
   (a) first means on said holder rotatable on a first axis to mount an insert for rotation comprising pressure discs to lie against opposite sides of an insert,
   (b) second means on said insert holder to drive said first means to cause rotation of an insert on said first axis during a grinding operation,
   (c) polygonal gauge means coaxial with and rotatable on said first axis having a polygonal shape comparable to an insert being ground, said gauge means being directly rotated by said drive means,
   (d) a limit block in contact with said gauge means to serve as a cam base for said gauge means to cause direct shifting of said holder in response to rotation of said gauge means and said insert whereby the contour of said gauge means is imparted to said insert as it contacts said rotating wheel,
   (e) said second means comprising a rotatable power source on said holder,
   (f) a resilient drive means connecting said source with said gauge means and said first means wherein a threshold torque is required to cam said gauge means on said limit block around corners on a polygonal gauge,
   (g) a switch means on said holder operatively associated with said rotatable power source to control the speed of said power source, and
   (h) means responsive to the direct shifting of said holder in response to rotation of said gauge means to actuate said switch means to increase the speed of rotation of said power source and said gauge and insert during the grinding of corners of an insert.

4. In a machine for grinding the flat edges of polygonal shaped cutting inserts which includes: a grinding wheel having a flat grinding surface, a means for rotating said wheel, and an insert holder for an insert to be ground comprising a movable body positioned adjacent said wheel, that improvement which comprises:
   (a) first means on said holder rotatable on a first axis to mount an insert for rotation comprising pressure discs to lie against opposite sides of an insert,
   (b) second means on said insert holder to drive said first means to cause rotation of an insert on said first axis during a grinding operation,
   (c) polygonal gauge means coaxial with and rotatable on said first axis having a polygonal shape comparable to an insert being ground, said gauge means being directly rotated by said drive means,
   (d) a limit block in contact with said gauge means to serve as a cam base for said gauge means to cause direct shifting of said holder in response to rotation of said gauge means and said insert whereby the contour of said gauge means is imparted to said insert as it contacts said rotating wheel,
   (e) a movable limit stop associated with said insert holder to maintain it temporarily in a position to hold an insert away from said grinding wheel,
   (f) said second means comprising a rotatable power source on said holder, and
   (g) control means associated with said rotatable power source on said holder to move said limit stop to allow said holder to move the insert into grinding contact with said wheel and operable simultaneously to actuate said power source.

5. In a machine for grinding the flat edges of polygonal shaped cutting inserts which includes: a grinding wheel having a flat grinding surface, a means for rotating said wheel, and an insert holder for an insert to be ground comprising a movable body positioned adjacent said wheel, that improvement which comprises:
   (a) first means on said holder rotatable on a first axis to mount an insert for rotation comprising pressure discs to lie against opposite sides of and insert,
   (b) second means on said insert holder to drive said first means to cause rotation of an insert on said first axis during a grinding operation,
   (c) polygonal gauge means coaxial with and rotatable on said first axis having a polygonal shape comparable to an insert being ground, said gauge means being directly rotated by said drive means,
   (d) a limit block in contact with said gauge means to serve as a cam base for said gauge means to cause direct shifting of said holder in response to rotation of said gauge means and said insert whereby the contour of said gauge means is imparted to said insert as it contacts said rotating wheel,
   (e) said second means comprising a rotatable power source on said holder, and
   (f) a resilient drive means connecting said source with said gauge means and said first means wherein a threshold torque is required to cam said gauge means on said limit block around corners on a polygonal gauge.

* * * * *